US011585100B2

(12) United States Patent
Allen

(10) Patent No.: US 11,585,100 B2
(45) Date of Patent: Feb. 21, 2023

(54) TILED FLOOR ASSEMBLY AND COMPONENTS

(71) Applicant: Warwick James Allen, Auckland (NZ)

(72) Inventor: Warwick James Allen, Auckland (NZ)

( * ) Notice: Subject to any disclaimer, the term of this patent is extended or adjusted under 35 U.S.C. 154(b) by 0 days.

(21) Appl. No.: 17/245,580

(22) Filed: Apr. 30, 2021

(65) Prior Publication Data

US 2021/0246667 A1 Aug. 12, 2021

Related U.S. Application Data

(63) Continuation-in-part of application No. PCT/IB2019/059326, filed on Oct. 31, 2019.

(30) Foreign Application Priority Data

Oct. 31, 2018 (NZ) ..... 747858
May 27, 2019 (NZ) ..... 753917

(51) Int. Cl.
*E04F 15/02* (2006.01)

(52) U.S. Cl.
CPC .... *E04F 15/02044* (2013.01); *E04F 15/0215* (2013.01); *E04F 2015/02055* (2013.01); *E04F 2015/02066* (2013.01)

(58) Field of Classification Search
CPC ..... E04F 15/02044; E04F 15/0215; E04F 2015/02066; E04F 15/02452; E04F 15/02458; E04F 15/02183
USPC ..... 52/126.1, 126.5, 263
See application file for complete search history.

(56) References Cited

U.S. PATENT DOCUMENTS 3,065,506 A * 11/1962 Tremer ..... E04F 15/02458 404/43
3,130,470 A * 4/1964 Bowden ..... E04G 11/48 211/186
3,316,680 A * 5/1967 Chrastek ..... E04F 15/02458 52/480
3,425,179 A * 2/1969 Haroldson ..... E04F 15/02452 52/301
7,707,780 B2 * 5/2010 Ouellet ..... E04C 3/083 52/126.5
8,438,805 B2 * 5/2013 Repasky ..... E04F 15/02183 52/263

(Continued)

FOREIGN PATENT DOCUMENTS

WO 2007113887 A1 10/2007

OTHER PUBLICATIONS

International Search Report and Written Opinion of International Searching Authority for International Application No. PCT/IB2019/059326.

*Primary Examiner* — Brian E Glessner
*Assistant Examiner* — Adam G Barlow
(74) *Attorney, Agent, or Firm* — JCIP; Joseph G. Chu; Jeremy I. Maynard

(57) ABSTRACT

A suspended timber frame deck comprising a timber frame of interconnected timber beams. Tiles are located on top of the beams indirectly at at least two locations by a tile support pad located between the tile and an underlying timber beam. Each pad includes a protrusion located in a hole of the timber beam to register therewith to the timber beam and registered to the tile to help locate the tile to the timber beam and help prevent the tile from sliding over the timber beam.

13 Claims, 10 Drawing Sheets

(56) References Cited

U.S. PATENT DOCUMENTS

| | | | | |
|---|---|---|---|---|
| 8,695,288 | B2 * | 4/2014 | Kugler | E04F 15/0247 52/126.5 |
| 8,984,832 | B2 * | 3/2015 | Busby | E04F 15/0215 52/126.5 |
| 2005/0284040 | A1 * | 12/2005 | Hashimoto | E04F 15/0247 52/126.1 |
| 2007/0245642 | A1 * | 10/2007 | Guldimann | E04F 15/183 52/126.5 |
| 2009/0266010 | A1 * | 10/2009 | Lomske | E04F 15/02183 52/794.1 |
| 2011/0192106 | A1 * | 8/2011 | Busby | E04F 15/08 52/582.1 |
| 2013/0318907 | A1 * | 12/2013 | Knight, III | E04F 15/04 52/698 |
| 2015/0096256 | A1 * | 4/2015 | Lam | E04F 15/02044 52/582.1 |
| 2015/0113903 | A1 * | 4/2015 | McManus | E04F 15/02044 52/745.13 |
| 2017/0037631 | A1 * | 2/2017 | McManus | E04F 15/082 |
| 2017/0138064 | A1 * | 5/2017 | Kugler | E04F 15/02494 |
| 2017/0152665 | A1 * | 6/2017 | Pelc, Jr. | E04B 1/003 |
| 2019/0316357 | A1 * | 10/2019 | McManus | E04F 15/08 |
| 2020/0190827 | A1 * | 6/2020 | Busby | E04F 15/02458 |
| 2020/0340255 | A1 * | 10/2020 | Weller | E04B 5/48 |

* cited by examiner

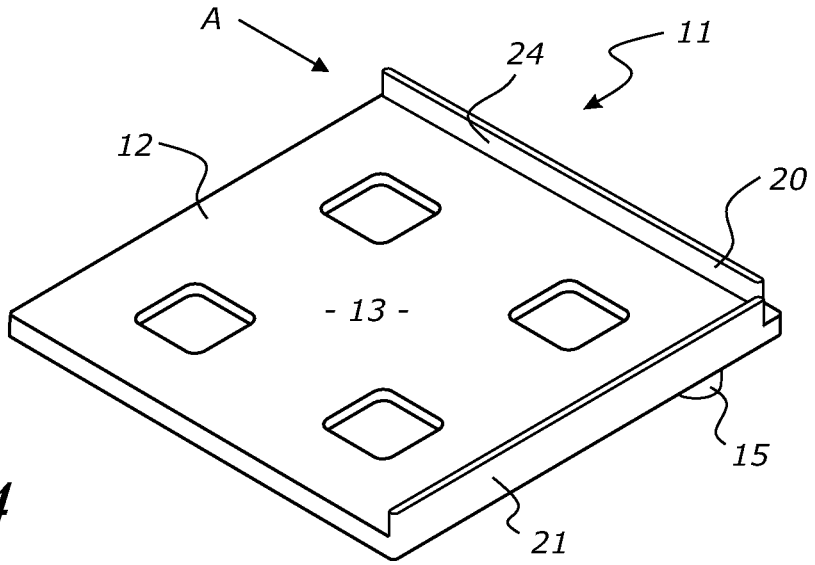
FIG. 4
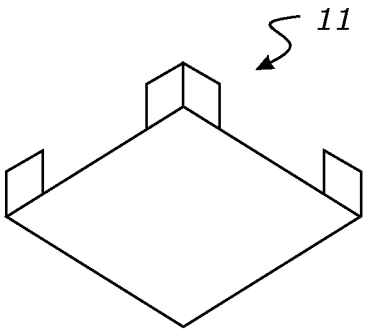
FIG. 5
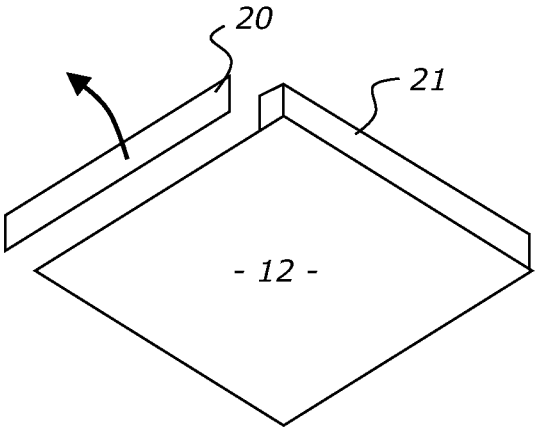
FIG. 6
FIG. 7
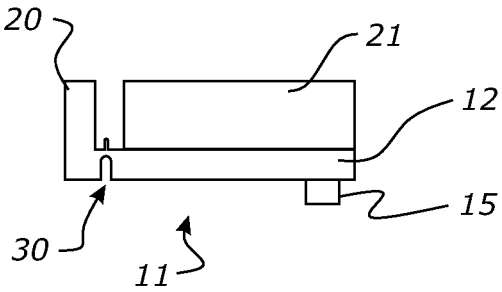

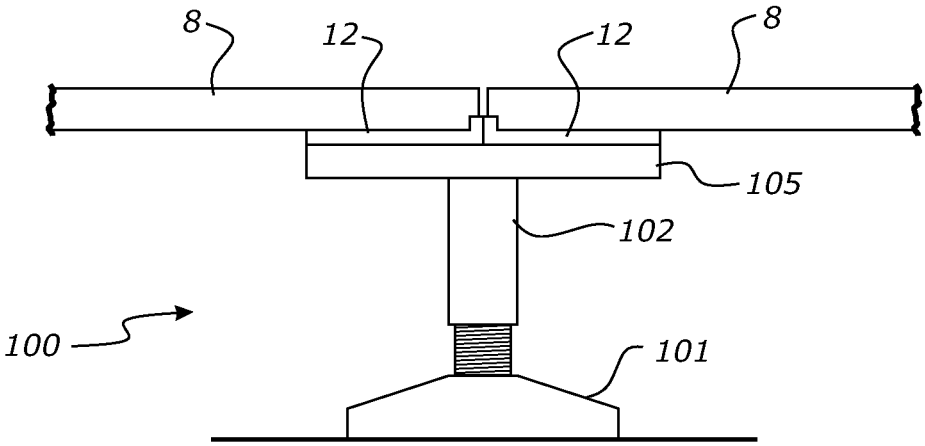
FIG. 12
FIG. 13
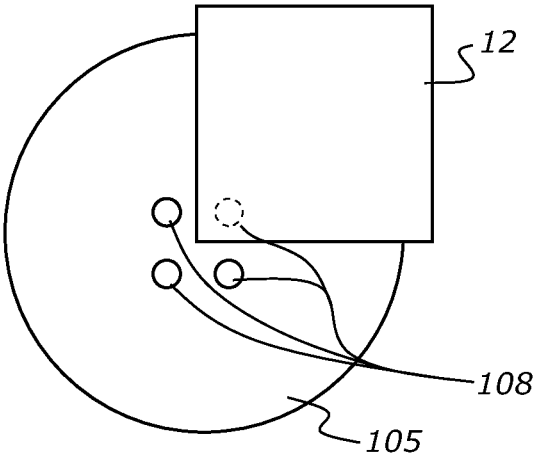
FIG. 14
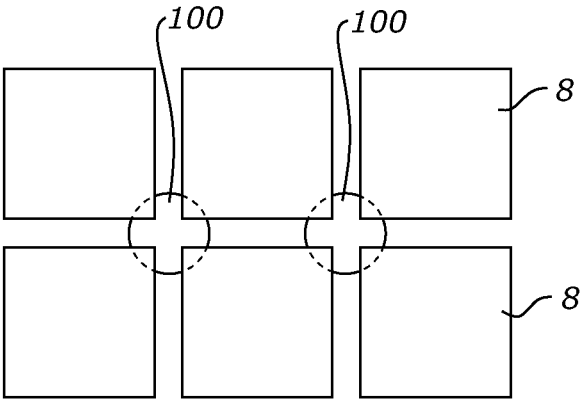

- 5 -

TILED FLOOR ASSEMBLY AND COMPONENTS

CROSS REFERENCE TO RELATED APPLICATIONS

The present application is a continuation-in-part of and claims the right of priority to PCT application no. PCT/IB2019/059326 having a filing date of Oct. 31, 2019, which claims the right of priority to New Zealand application nos. NZ 747858 having a filing date of Oct. 31, 2018 and NZ 753917 having a filing date of May 27, 2019. The entirety of the contents of each of these respective applications are hereby incorporated by reference in their entireties.

FIELD OF INVENTION

The present invention relates to a tiled floor assembly, placer and methods of tiling of or for a suspended deck. It may also relate to a method of tiling a suspended timber frame decking and related components and systems.

BACKGROUND

Suspended timber frame decks are common and help address moisture penetration problems for buildings. Such decks are typically constructed on a sub structure that may be part of the roof or ceiling of a dwelling below. A timber frame is supported by spaced apart props and the frame is constructed to receive decking material in the form of timber planks that are nailed or screwed to the timber framing below.

Some prefer the look, ease of maintenance or durability of tiles compared to timber planks. Tiles are typically made from a hard material such as a ceramic and are hard to drill holes through for the purposes of fastening them to a substructure.

Tiles are able to be adhesively fastened to a substrate such as a tile sheet underlay that is made from a cementitious material. But for decking such a tile sheet underlay interferes with the flow of rain water through the deck for drainage purposes.

It may therefore be an object of the present invention to provide a tiled floor assembly that addresses the abovementioned problems and/or that will at least provide the public with a useful choice.

It may also therefore be an object of the present invention to provide a placer of or for a suspended deck that addresses the abovementioned problems and/or that will at least provide the public with a useful choice.

It may also therefore be an object of the present invention to provide a methods of tiling of or for a suspended deck that addresses the abovementioned problems and/or that will at least provide the public with a useful choice.

BRIEF DESCRIPTION OF THE INVENTION

Accordingly in a first aspect the present invention may broadly be said to be a tiled floor assembly (whether wholly or partly within a building envelope or not), the assembly comprising or including:

(i) a substructure whether of an assembly or discrete elements located above a substrate (whether the substrate has a fall or not and/or whether the substrate is membraned or not), the substructure having an array of locating indexing features, (ii) multiple tile footing pads supported by the substructure, each pad to support one or more tile, and each pad indexed by at least one pad indexing feature with the a locating indexing feature, and (iii) tiles each supported in part at each right angled or obtuse angled corner region by a pad; wherein each tile is adhered to at least one or more of its pads.

Preferably the substructure is a frame (eg of timber).

Preferably the substructure is a frame floating (eg on footings, pedestals or the like) above the substrate the frame having an array of locating indexing features, and wherein multiple tile footing pads are supported by the frame, each pad to support one or more tile, and each pad indexed by at least one pad indexing feature (that may be protuberance for example) into a locating indexing feature.

Preferably the substructure comprises of a plurality of spaced apart height adjustable props.

Preferably the props present an upper bearing member onto of which at least one pad can be placed and supported to support a tile at its corner, the bearing member presenting the locating indexing feature to register the pad thereat.

Preferably the bearing member presents a plurality of locating indexing features.

Preferably the bearing member presents 4 locating indexing features so that 4 pads can be supported at a said prop.

Preferably the frame is a timber frame comprised of a plurality of timber beams connected to each other at beam intersections.

Preferably the timber beams extend parallel and at right angles to each other.

Preferably the timber beams are coplanar each other.

Preferably the timber beams each present a coplanar upwardly facing surface into which the locating indexing features are provided.

Preferably the tiles are or are to be arranged in a parallel manner with the upwardly facing surfaces.

Preferably the locating indexing features are arranged in a regular formation relative to each other.

Preferably the timber frame is floating on footings that are preferably adjustable in height above a substrate Preferably the frame has an array of locating indexing features formed by post frame construction drilling of the timber frame.

Preferably multiple tile footing pads are supported by the frame on top of the upwardly facing surfaces of the timber frame.

Preferably multiple tile footing pads are supported by the substructure on top of the upwardly facing surfaces of the substructure.

Preferably each pad supports one or more tiles.

Preferably each pad supports one tile only.

Preferably four pads in total support a said tile.

Preferably each pad is indexed by its pad indexing feature being preferably at least one protuberance into a locating indexing feature, and (iii) tiles each supported in part at each right angled or obtuse angled corner region by a pad; wherein each tile is adhered in an indexed relativity to at least one or more of its pads.

Preferably each pad is a moulded item.

Preferably each moulded item has frangible or non frangible flanges, lips or the like against each of which a tile can abut to attain said indexed relativity.

Preferably each tile has right angled corners (eg is a square or rectangular tile and is not a hexagonal tile) and each pad in the array may support only one tile at one of its corners or may support juxtaposed tiles at their mutually proximate corners, whether two or four mutually proximate corners.

Preferably each tile is quadrilateral in shape and has right angled corners and each pad in the array may support only one tile at one of its corners.

Preferably the locating indexing features are timber jig drilled to provide the array of locating indexing features.

Preferably each pad indexing feature and locating indexing feature has a tapering inter-relationship.

Preferably each protuberance is tapered towards it free distal end.

Preferably the tapering inter-relationship is not adhesively fixed.

Preferably at least some of the pads have been adhesively affixed to a tile prior to pad placement on the frame.

Preferably at least some of the pads have been placed on the frame prior to being adhesively affixed to a tile.

Preferably each pad is substantially incompressible.

Preferably each pad provides, in-situ a noise transmission reduction function to reduce noise transmission across the assembly.

Preferably the tiles are not grouted.

In a second aspect the present invention broadly consists in a footing pad for a corner region support and indexing of a tile (eg as in an assembly as herein described), each pad, when notionally in an orientation in which it will be laid, upwardly defining an indexed placement and supporting position for its or a tile, and downwardly defining at least one indexing protuberance.

Preferably the upwardly defining indexed placement and supporting position for its or a tile is provided by a base member of the pad on which the tile can be placed and at least one peripheral lip is provided from the base member to locate at a tile corner to two adjacent edges of the tile.

Preferably at least part of the peripheral lip is severally attached to the base member.

Preferably at least part of the peripheral lip is able to be snapped off the base member.

Preferably a line or region of weakness is located between at least part of the lip and the base member.

Preferably the lip, when in-situ does not protrude above the upper surface of the tile.

Preferably the base member elevated the tile above the frame by at least 2 mm and preferably no more than 10 mm.

Preferably the downwardly defined indexing protuberance extends from the base member.

Preferably the protuberance is a pin.

Preferably the protuberance is circular in cross section.

Preferably both an area and lip provides the indexed placement and supporting position.

Preferably the or each protuberance is tapered.

In a further aspect the present invention broadly consists in a preinstalled condition a pad as herein before described and a tile adhered thereto.

Preferably the pad is or is to be supported on a substructure as herein described.

In a further aspect the present invention broadly consists in, in a preinstalled condition, the combination of both a frame and the multiple footing pads of or suitable for an assembly as herein before described.

In a further aspect the present invention broadly consists in, the combination as hereinbefore described, also with the tiles.

In a further aspect the present invention broadly consists in a method of tile installation on a floating wooden frame (preferably to provide an assembly as herein before described), said method comprising or including placing the frame already fully with indexing holes and/or placing the frame and, once the frame has been placed, jig drilling any holes required or still required in the frame for indexing purposes, placing footing pads so that each is indexed to a said hole, and placing tiles on the pads and/or placing with their pad or pads tiles on the frame.

Preferably each tile is adhesively affixed to at least one pad prior to and/or after pad placement on the frame.

Preferably the holes are blind tapered holes.

Preferably the method as herein described provides an assembly as herein before described.

Preferably the pad is square in plan view.

Preferably the pad is no larger than 200 square centimetres.

Preferably the pad is no larger than 100 square centimetres.

Preferably the pad is pad is made from a plastics material.

Preferably the pad is made from a hard plastics material.

Preferably the pad is made as a one piece moulded plastic.

Preferably the pad has a base to be supported on the frame that is of a surface profile that helps reduce the trapping of water between the pad and the frame compared to if the surface was flat.

Preferably the pad has a base to be supported on the frame that is corrugated.

Preferably the pad has a base that is castellated to create air passages between the pad and the frame when the pad is located to the frame.

In a further aspect the present invention is a suspended timber frame deck comprising a timber frame of interconnected timber beams extending parallel and perpendicular to each other to define a plurality of interstices each covered by at least one quadrilateral tile supported at at least two and preferably each of its edges by as said beam of the timber frame, indirectly at at least two locations by a tile support pad located between the tile and an underlying timber beam, the pad including a protrusion located in a hole or against an edge of the timber beam to register therewith to the timber beam and registered to the tile to help locate the tile to the timber beam and help prevent the tile from sliding over the timber beam.

In a further aspect the present invention is said to be a tiled floor assembly, the assembly comprising or including:

(i) a substructure positioned above a substrate, (ii) multiple tile footing pads supported by the substructure and/or by a plurality of intermediate members arranged at or atop the substructure, each pad to support one or more tile, and each pad indexed by at least one pad indexing feature cooperating with a locating indexing feature of an array of locating indexing features provided by the substructure and/or by the plurality of intermediate members, and (iii) tiles each supported in part at each right angled or obtuse angled corner region by a pad; wherein each tile is adhered to at least one or more of its pads.

Preferably, said multiple tile footing pads are supported by the substructure on top of upwardly facing surfaces of the substructure and/or atop upper surfaces of the plurality of intermediate members.

Preferably, each pad is indexed by its pad indexing feature being at least one protuberance cooperating with or into a locating indexing feature, wherein each tile is adhered in an indexed relativity to at least one or more of its pads.

Preferably, each pad is a moulded item.

Preferably, the pad has frangible or non frangible flanges, lips against each of which a tile can abut to attain said indexed relativity.

Preferably, each tile has right angled corners and each pad in the array supports at least one of (a) only one tile at one of its corners and (b) juxtaposed tiles at their mutually proximate corners, whether two or four mutually proximate corners.

Preferably, each pad indexing feature and locating indexing feature has a tapering inter-relationship.

Preferably, the substructure is a frame so positioned above the substrate by way of footings, the frame providing said array of locating indexing features, and wherein the multiple tile footing pads are supported by the frame, each pad to support one or more tile, and each pad indexed by said at least one pad indexing feature cooperating with said locating indexing feature.

Preferably, the frame is a timber frame comprised of a plurality of timber beams connected to each other at beam intersections.

Preferably, the timber beams extend parallel and at right angles to each other.

Preferably, said multiple tile footing pads are supported by the timber frame on top of upwardly facing surfaces of the timber frame and/or atop upper surfaces of the plurality of intermediate members arranged at the timber frame or atop said upwardly facing surfaces of the timber frame.

Preferably, each intermediate member comprises at least one locating indexing feature provided by a hole extending at least partially therethrough.

Preferably, each intermediate member comprises two to four locating indexing features provided by two to four holes extending at least partially therethrough arranged at corners of said intermediate member.

Preferably, said hole(s) comprising a countersunk chamfer.

Preferably, the intermediate members are configured to be affixed to the substructure by way of adhesive and/or by way of at least one fastening member connecting said intermediate member to said substructure.

Preferably, each intermediate member comprises a fixture perforation configured to cooperate with said fastening member to connect the intermediate member to or atop the substructure.

Preferably, said fastening member comprising a nail, stud or screw.

Preferably, each intermediate member is frangible along channels extending across upper or lower surfaces of said intermediate member.

Preferably, the substructure comprises of a plurality of spaced apart height adjustable props.

Preferably, the props present an upper bearing member onto of which at least one pad is positioned and supported to support a tile at its corner, the bearing member presenting the locating indexing feature to register the pad thereat.

Preferably, the upper bearing member presents a plurality of locating indexing features.

Preferably, the bearing member presents four locating indexing feature so that four pads can be supported by a said prop.

Preferably, the bearing member comprises a flange extending upwardly therefrom to affix a lateral part of the substructure thereto.

Preferably, said flange is frangible so as to be removable from the prop.

In a further aspect the present invention is said to be a method of tile installation on a substructure, said method comprising or including:

placing the substructure and affixing a plurality of intermediate members thereto, placing footing pads so that each is indexed to a hole of an array of holes provided by the intermediate members, and placing tiles on the pads and/or placing them with their pads on the frame; wherein each tile is affixed to at least one pad prior to or after pad placement on the intermediate members.

In a further aspect the present invention is said to be a method of tile installation on a substructure, said method comprising or including:

placing the substructure and/or affixing a plurality of intermediate members to the substructure, said intermediate members and/or said substructure presenting an array of indexing holes, placing footing pads onto the substructure and/or intermediate members so that each is indexed to a hole of the array of indexing holes and then placing tiles on the pads and affixing them thereto and/or affixing the pads to the tiles and then placing the pads onto the substructure and/or intermediate members so that each is indexed to a hole of the array of indexing holes.

In a further aspect the present invention may comprise a kit of parts for assembling a plurality of tiles to form a tiled floor on or atop a substructure positioned above, and/or or supported by a substrate, said kit of parts comprising:

a plurality of tile footing pads configured to support one or more tile of the plurality of tiles, each pad comprising a pad indexing feature;

said plurality of tile footing pads being arrangeable by a user to locate and connect the plurality of tile footing pads to the substructure through engagement of the pad indexing features of each pad with a locating indexing hole of an array of locating indexing holes provided by or forming part of the substructure, wherein the plurality of tiles are supported by the plurality of tile footing pads and affixable thereto to form said tiled floor.

Preferably, the kit of parts further comprises at least one drilling jig arrangeable atop or connectable to the substructure to provide a guide for drilling into the substructure to thereby form at least one locating indexing hole of said array of locating indexing holes into said substructure.

In a further aspect the present invention may comprise a kit of parts for assembling a plurality of tiles to form a tiled floor on or atop a substructure positioned above, and/or or supported by a substrate, said kit of parts comprising:

a plurality of tile footing pads configured to support one or more tile of the plurality of tiles, each pad comprising a pad indexing feature; and a plurality of intermediate members and/or a plurality of height-adjustable props;

said kit of parts being arrangeable by a user to locate and connect the plurality of tile footing pads to the plurality of intermediate members, the plurality of height-adjustable props and/or to the substructure itself through engagement of the pad indexing features of each pad with a locating indexing hole of an array of locating indexing holes provided by or forming part of the intermediate members, the height adjustable props and/or the substructure itself, wherein the plurality of tiles are supported by the plurality of tile footing pads and affixable thereto to form said tiled floor.

Preferably, the plurality of intermediate members are configured to affix to or atop the substructure.

Preferably, the plurality of height-adjustable props are configured to affix to the substructure.

Preferably, at least a portion of the substructure may be formed by the plurality of height-adjustable props.

Preferably, the plurality of height-adjustable props are arranged atop the substrate to support and connect to the substructure and/or to form at least a portion of the substructure.

Preferably, the kit of parts further comprises at least one locating jig arrangeable atop or connectable to the substructure to locate said plurality of intermediate members for connection thereto.

Preferably, the kit of parts further comprises a plurality of levelling wedges arrangeable beneath the plurality of height adjustable props to support said plurality of height adjustable props atop the substrate.

Preferably, the kit of parts further comprises at least one drilling jig arrangeable atop or connectable to the substructure to provide a guide for drilling into the substructure to thereby form at least one locating indexing hole of said array of locating indexing holes into said substructure.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

BRIEF DESCRIPTION OF THE DRAWINGS

The invention will now be described by way of example only and with reference to the drawings in which FIG. 4 is a perspective view of a pad of the present invention, FIG. 5 is a perspective view of an alternative pad of the present invention, FIG. 6 is a perspective view of a pad with a lip having been removed, FIG. 7 is a side view of a pad as seen in direction A shown in FIG. 4

FIG. 12 is a side view of part of two tiles supported on a prop each by one pad for each corner, FIG. 13 is a plan view of a prop and a pad shown supported on the prop, and FIG. 14 is a plan view of a plurality of tiles and props.

DETAILED DESCRIPTION

Figure 1:
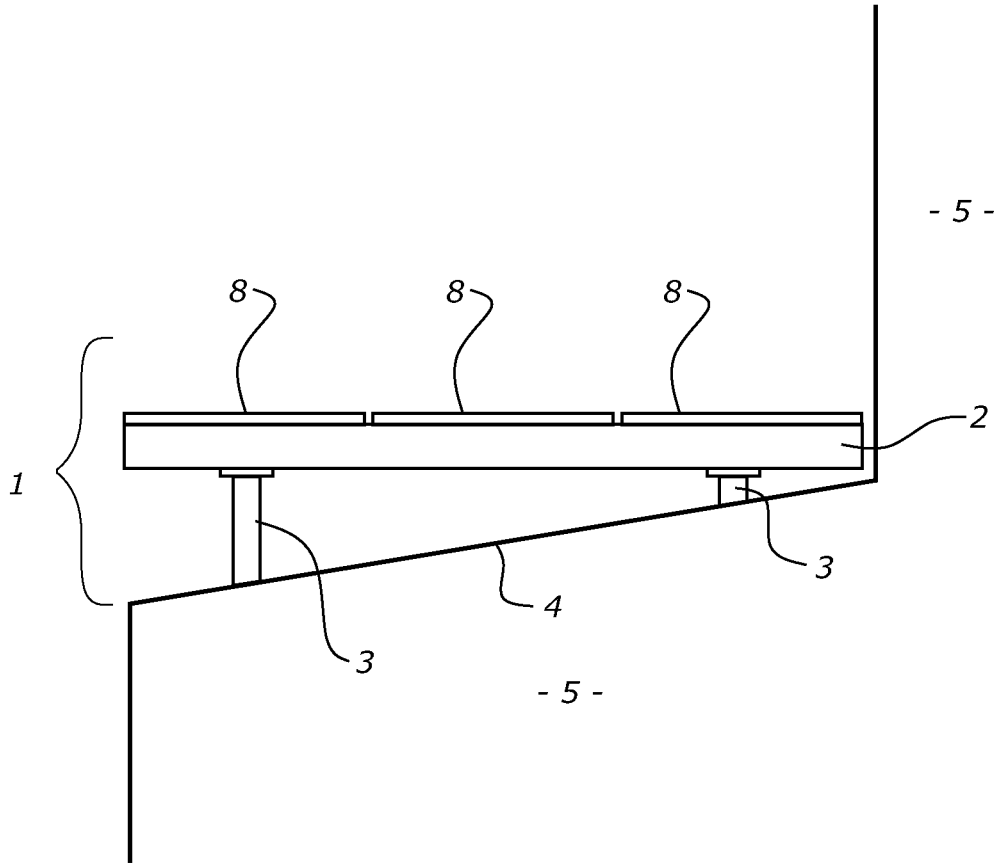
FIG. 1 is a side view of a tiled floor assembly provided adjacent a building structure.

More detail of the invention of which examples as shown in the drawings, will now be described.

Figure 2:
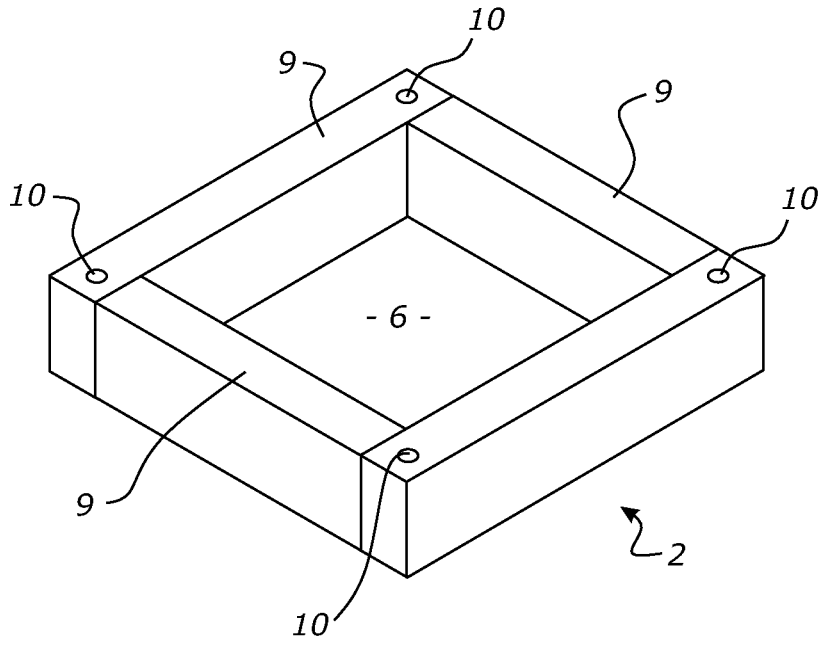
FIG. 2 is a perspective view of part of a frame of the assembly of FIG. 1.
Figure 3:
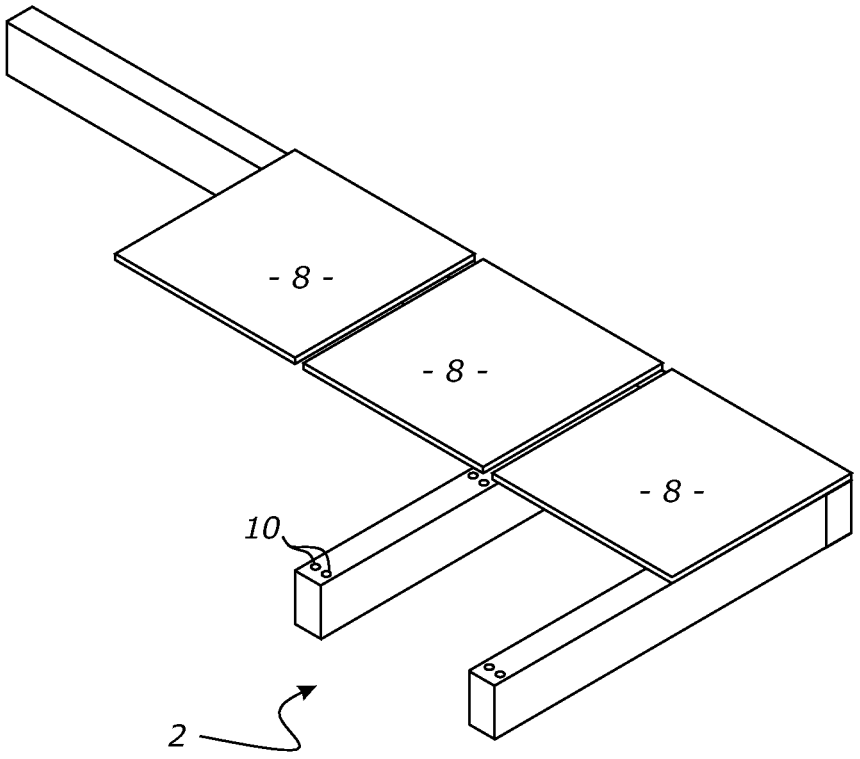
FIG. 3 is a partially assembled tile floor assembly of the assembly as shown in FIG. 1.

FIG. 1 is a side sectional view of a tiled floor assembly 1. It comprises a substructure such as a frame 2 that may be supported by footings 3 on a substrate 4 of a structure 5 such as a building structure. The substructure is preferably a frame 2 that is preferably a timber frame as seen in FIGS. 2 and 3. It may have a plurality of openings or interstices 6 framed by sections of the timber defining the timber frame 2. The sections of timber are preferably timber beams that run parallel and perpendicular to each other. The construction of the frame may come in many forms as are already known in the building industry. An alternative of the substructure is shown in FIG. 12-14 wherein there is shown a height adjustable prop 100 sitting on a structure. A plurality of such props may be provided for supporting tiles thereon in a manner that will be described below.

The timber frame provides the supporting structure for tiles 8 to be located on top to in part define the tiled floor assembly of the present invention. The tiles are preferably supported on top of the upwardly facing surfaces 9 of the timber frame members and are held in place in a horizontal direction by virtue of the use of locating indexing features 10 preferably in the form of holes provided in the timber frame members at appropriate locations.

Figure 8:
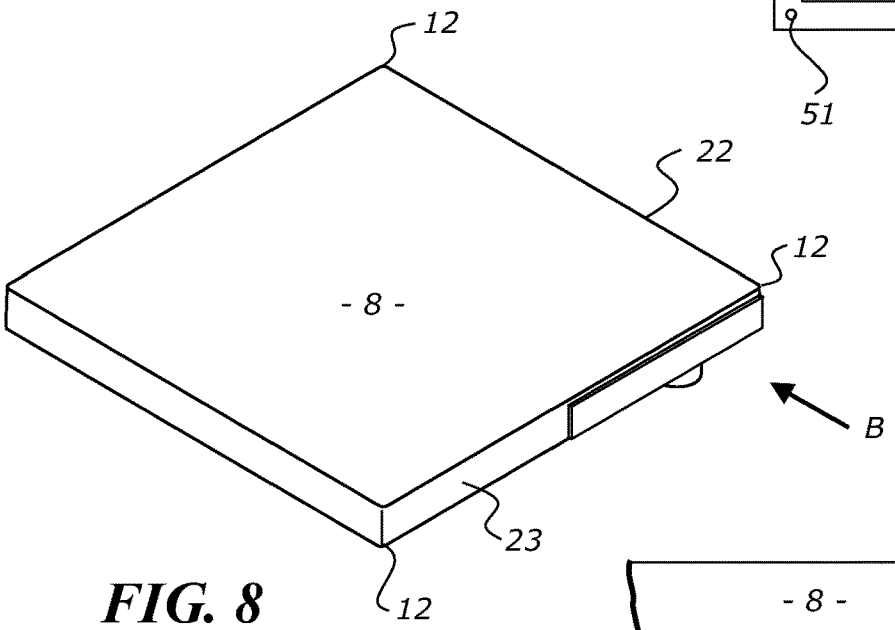
FIG. 8 is a perspective view of a tile with one pad engaged therewith.
Figure 9:
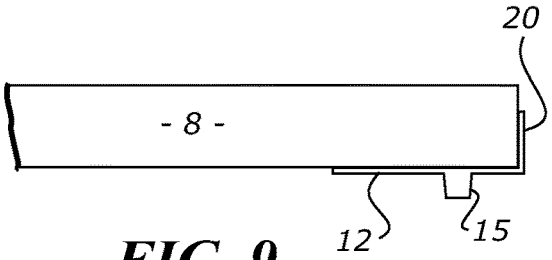
FIG. 9 is a view of the tile and pad of FIG. 8 seen in direction B.
Figure 10:
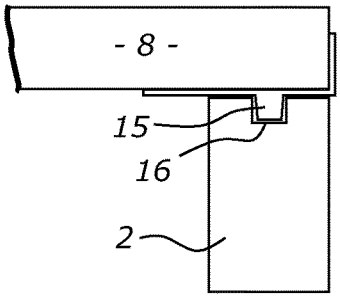
FIG. 10 is a sectional view through a frame, pad and tile.

The tiles 8 index with these locating indexing features 10 using at least one and preferably a plurality of tile footing pads 11 of a kind as seen as an example in FIG. 4. The tile footing pads are preferably located at each of the corners 12 of a tile, one of such footing pads shown insitu with a tile in FIG. 8.

Each pad 11 comprises of a base 12 on top of which a tile is able to be placed. An adhesive may be applied between the upper facing surface 13 of the base and a downwardly facing surface of the tile so that the pad 11 and the tile are able to be adhesively affixed to each other. This adhesive affixing may occur after the pad has been placed on the frame and registered with a locating indexing feature. In the preferred mode of installation 4 pads are placed on the framing for a tile to then be adhered to the 4 pads. The pads themselves are preferably not adhered to the framing. This allows the tiles to be lifted from the framing at a later date (eg to repair them or to gain access to underneath the tiles and/or framing).

The base includes a protrusion 15. This is able to index with a locating indexing feature 16 of the frame. Such a locating indexing feature may be an opening hole or depression and in the preferred form is a blind hole as seen in FIG. 11.

It should be noted that the term locating indexing feature may be used in reference to FIGS. 1 to 14 and elsewhere in this specification when describing embodiments of the tiled floor assembly whereby these locating indexing features are drilled or otherwise formed into a substructure such as a frame, timber frame and the like. In embodiments described further below with reference to FIGS. 15 to 17, where intermediate members 200 are provided between the pads and said substructure, frame or timber frame, the term locating indexing feature is also used for consistency. A person skilled in the art will appreciate that the functions and features of the locating indexing feature described throughout may apply equally irrespective of whether said locating indexing feature is part of the substructure, frame, timber frame and the like, or the intermediate members 200, said locating indexing features being configured to provide the same function of locating/Indexing the pads.

In the preferred form the blind hole is created by drilling of the timber framing member at where the pad is to be located to the frame. The drilling of the blind hole is preferably achieved by the use of a drilling jig 50 as seen in plan view in FIG. 7*b*. A drill bit is used to penetrate a guiding region 51 to accurately and angularly locate and present the blind hole for a subsequent engagement of the protrusion 15 of the pad. The jig may include 4 holes 51 as alignment regions so that 4 holes can be drilled in quick succession into the timber frame in locations that space the 4 holes accurately from each other. Additional jig positioning features 52 may be provided. In the preferred form such may be protrusions that are located in a manner to index with two prior drilled holes in the frame. This then positions the jig for the next 4 holes to be drilled relative to two prior holes. Whilst in the preferred form the jig may help drill 4 holes in one just set position it will be appreciated that such drilling of more or less holes may be facilitated by a jig.

Figure 11:
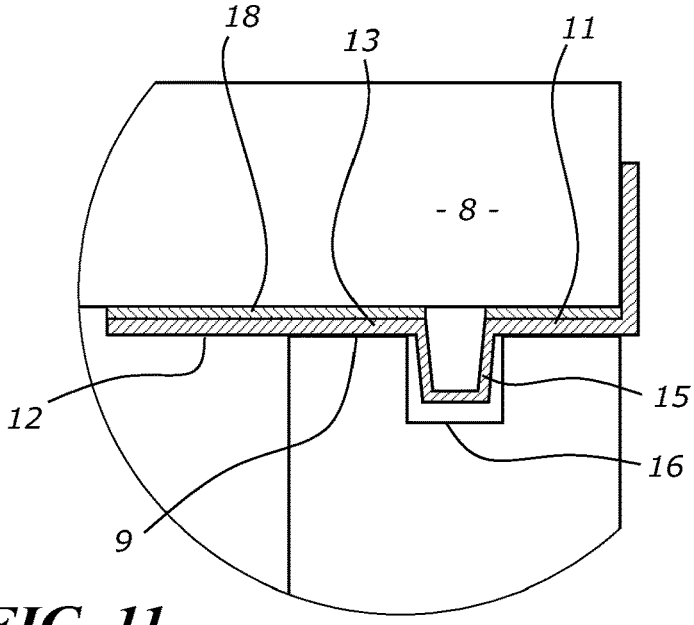
FIG. 11 is a close up sectional view of a tile and pad and frame illustrating use of an adhesive between the tile and the pad.

As can be seen in FIG. 11 the protrusion is preferably of a tapered shape extending away from the base 12 of the pad 11. This allows for an easy removal of the pad from the timber framing without needing to do any significant prying of the pad to remove it from the timber framing. It also creates a solid indexing of the pad with the timber framing when the protrusion is pushed sufficiently down into the blind hole 16. The maximum diameter of the protrusion is preferably slightly larger than the diameter of the blind hole 16 so that a wedging action occurs near the entrance of the blind hole as can be seen in FIG. 11.

The timber framing at its upwardly facing surface 9 is able to receive the downwardly facing surface of the pad.

The upwardly facing surface of the pad 13 is able to be adhesively affixed by the use of an adhesive 18 to the tile 8.

The base 12 of the pad 11 preferably includes at least one, and as shown in FIG. 4, preferably two lips 20 and 21. These lips provide a registration surface for the edge or edges 22 and 23 of the tile to register with. It allows for an accurate placement of the pad with a tile at a corner 12 of the tile as sheen in FIG. 8. This in turn locates the protrusion of the pad in an accurate location of the tile so that for each tile used in the assembly there is consistency of protrusion location for each tile.

The lip or lips extend upwardly from the base 12 of the pad sufficiently to present a surface such as surface 24 against which an edge of a tile is able to register/abut. The lip may be continuous along the length of the base 12 or in an alternative form a plurality of lips may be presented along a length of a base as seen in FIG. 5. The FIG. 5 configuration still allows for the pad to register at a corner of a tile and to present the protrusion 15 in a determined location relative to the tile for registration with the blind hole of the timber frame.

It will be appreciated that a provision of pads at at least two corners of a tile will allow for a translational and rotational fixing of a tile relative to a frame in the tile plane direction. I.e., the tile will not slide over the frame although may still be lifted off the frame. Therefore, in use it is preferred that at least two pads are used per tile to locate the tile to the frame and to prevent it from sliding or rotating off the timber framing. Or that at least one pad provides two spaced apart protrusion for engagement in two spaced apart holes of the frame. In some embodiments of the pad, the pad may extend from one tile corner to the other. And a or adjacent each corner a pad protrusion is provided by the one pad.

The preferred form of the invention utilises a pad at each of the four corners of a tile. The tiles are preferably ceramic tiles and are preferably of a square or rectangular format. Each pad hence has, in the preferred form, two lips 20 and 21 that extend at right angles to each other. This allows for a corner region to be defined by the pad at where a corner of a tile is able to nest. This can be seen in FIG. 9.

In some instances it may be desirable for the lip of a pad to be removed or removable. This may desirable where a tile edge is exposed and not contiguous an adjacent tile or other building structure. The lip 20 of a pad is hence preferably able to be removed from the pad. A or each lip is able to be removed from the pad base to by hand or by a tool such as pliers.

Figure 7A:
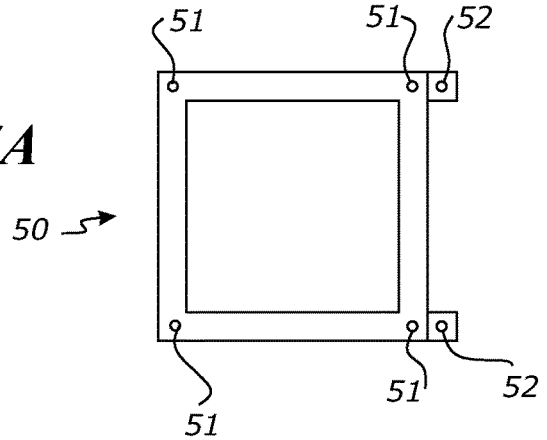
FIG. 7*a* is a plan view of a drilling jig.

In one example such removal may be by hand or by way of a tool such as pliers and the provision of a frangible region 30 between the lip 20 and the base 12 of a pad as seen in FIG. 7.

The lip 20 is hence able to be snapped away from the base 12 as seen in FIG. 6. The frangible region may be a line of weakness or perforations between the lip 20 and the base 12. In one form either one or both of the lips of a pad are so removable.

Once a deck frame, such as a floating frame of the assembly of the present invention, has been assembled or placed such as above a building structure as seen in FIG. 1, the process of applying the tile cladding for the frame 2 is able to commence. This may involve the drilling of blind holes into the frame, as for example, seen in FIG. 2. A drilling jig that may comprise of a frame presenting 4 pilot holes that are both spatially and angularly position relative to each other can be used for the purposes of drilling four holes in a frame to receive the four pads of or for a tile. The four holes are shown in FIG. 2 as an example. Pads may then be located by pushing the protrusion into the blind holes to the frame. Subsequent to this an adhesive may be applied to the upper surfaces of the base 12 of each of the pads 11 and a tile may then be placed onto each of the upwardly facing surfaces 13 to become adhesively affixed to each of the pads 11. Before the adhesives cures the tile is able to be moved around if necessary relative to the pads, however an accurate drilling of each of the blind holes 10 for a particular tile shape and shape or configuration of the pads should allow for a tile to be placed accurately with its corners abutting the lips 20 and 21 of each of the pads. Whilst lips are a preferred form of helping to secure a tile in place on timber framing in alternative forms the pad may not include such lips. Instead the adhesive fastening of a tile to a pad provides the secure location of a tile to a timber framing rather than in addition the mechanical indexing that is provided by the lip or lips of the pad. However, over time adhesive may deteriorate in weathered situations and the strength of the adhesive bond between a tile and a pad may reduce. The provision of the lips continues to provide for a location of the tile in the planar direction of the tile. A release of the adhesive may allow for tiles more easily lift from the framing and the pad but the lips will continue to hold the tiles in the in planar direction of the tile. The use of adhesive is optional but preferred.

In an alternative embodiment of the invention, the tiled floor assembly may benefit from not requiring holes to be drilled or otherwise formed into the substructure. Instead, it may be preferable if the locating indexing features are provided by an intermediate member affixed to connected to or atop the substructure, thereby eliminating the need to ensure the holes drilled into the substructure be properly positioned for correct tile alignment.

Figure 16A:
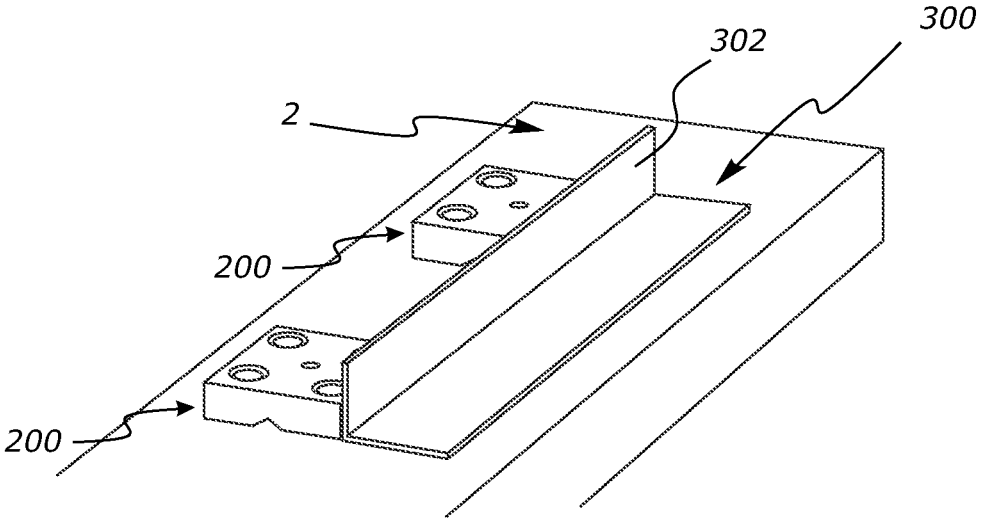
FIG. 16A is a perspective view of a locating jig and intermediate members.

In such an embodiment, the tile floor assembly may comprise a plurality of intermediate members 200 as shown in FIG. 16A. The intermediate members 200 may be arranged at or atop the substructure, and provide said array of locating indexing features hereinafter referred to as locating indexing features 202, wherein said locating indexing features 202 may be configured similarly or share the same functions and features of the locating indexing features 10 described hereinbefore, as explained above. The multiple tile footing pads may be supported atop upper surfaces 201 of the plurality of intermediate members 200 arranged at the frame 2 or atop said upwardly facing surfaces 9 of the frame 2.

Each intermediate member 200 may be configured to be affixed to the substructure by way of adhesive and/or by way of at least one fastening member connecting said intermediate member to said substructure. For instance, the intermediate member 200 may be glued to an intersection of the timber frame 2 of FIG. 2, so as to provide locating indexing features 202 at substantially the same location as the locating indexing features 10 of FIG. 2.

Alternatively, or additionally, the intermediate members 200 may be affixed to the substructure or frame 2 by means of a fastening member such as a nail, stud, screw or the like. In that regard, the intermediate member 200 may comprise a fixture perforation 204 configured to cooperate with said fastening member to connect the intermediate member 200 to or atop the substructure or frame 2. This fixture perforation 204 may comprise a hole extending fully through the intermediate member 200 as shown in FIG. 15. Those skilled in the art may also contemplate other mechanical means of affixing the intermediate member 200 to the substructure or frame 2 that do not require a fixture perforation 204.

The intermediate member 200 provides the benefits of additional sound deadening or acoustic dampening to a substructure as it is preferably formed from rubber or other like materials having such acoustic dampening properties. Further, much like the drilled locating indexing features 10 described hereinbefore, the intermediate members 200 help to prevent planar translation of the pads and tiles connected thereto.

Figure 16B:
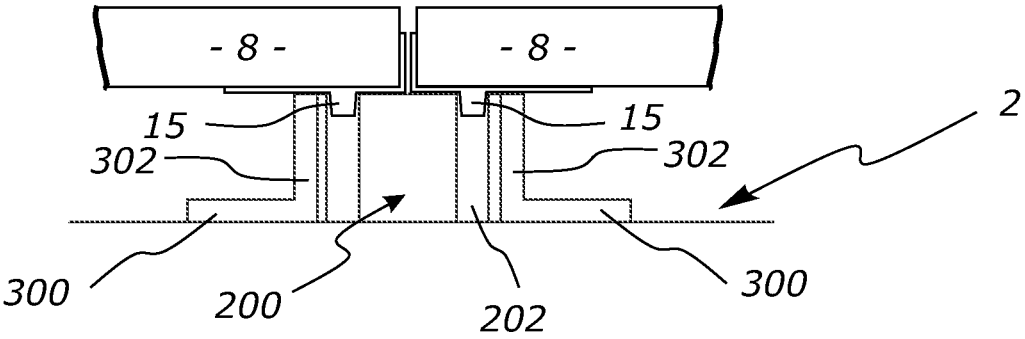
FIG. 16B is a cross sectional view two locating jigs and an intermediate member.
Figure 16C:
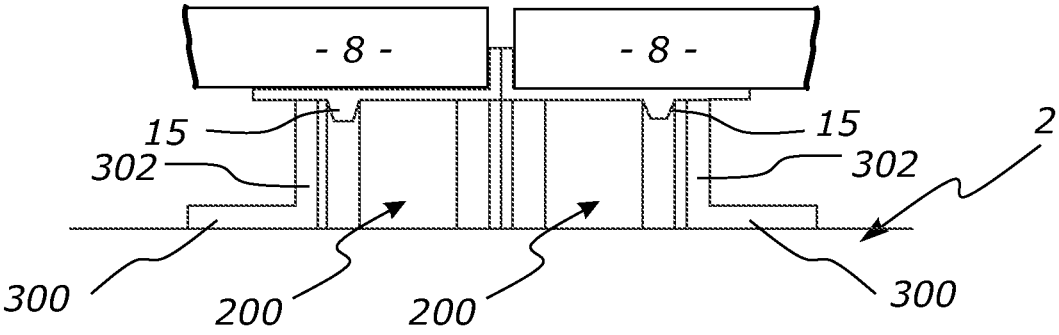
FIG. 16C is a cross sectional view of two locating jigs and two intermediate members.

The intermediate members 200 may be located in their appropriate positions through use of a locating jig 300 as shown in FIGS. 16A-16C. The locating jig 300 is shown as an elongate 'L' shaped bar, wherein side flanges 302 of the locating jig 300 may be used to place intermediate members 200 there against for appropriate alignment and positioning of said intermediate members 200 along a substructure or frame 2. The locating jig may act as a straight edge for the location of the intermediate members 200. The locating jig 300 may be bolted or otherwise temporarily fixed to the frame 2 to provide a stable surface for positioning against. This is shown in FIG. 16B, where an intermediate member 200 is positioned against said side flanges 302 of two locating jigs 300, with pads and associated tiles 8 positioned appropriately.

Alternatively, as shown in FIG. 16C, a pair of intermediate members 200 may be positioned along side one another and flanked on opposing sides by side flanges 302 of two locating jigs 300. Further, the locating jig 300 may take other cross-sectional shapes, such as a 'U' shape rather than an 'L' shape, whereby intermediate members 200 are placed in between side walls of said 'U'.

Figure 19:
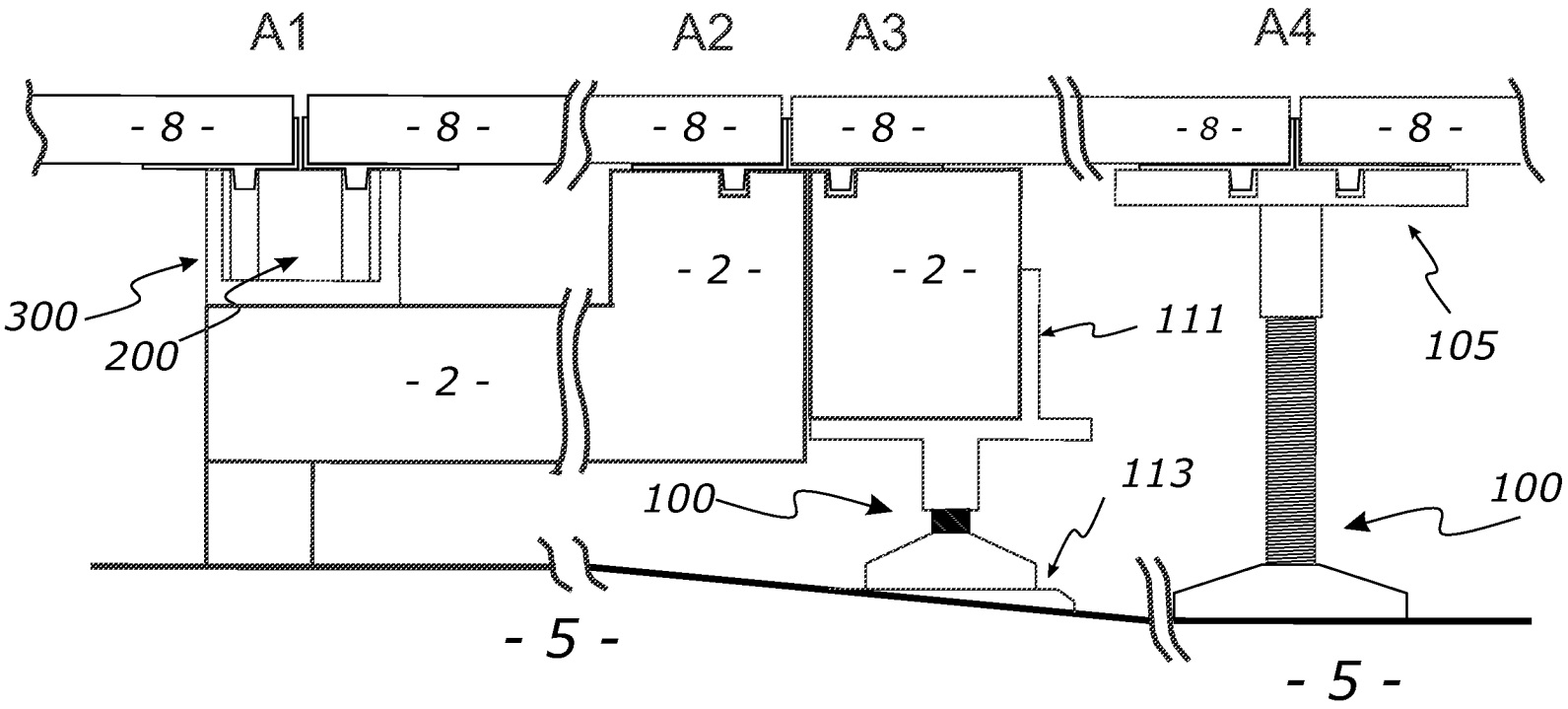
FIG. 19 is a side view of a tiled floor assembly.

Further, in some embodiments, the locating jigs 300 may be permanently affixed to the substructure or frame 2, such that the intermediate members 200 are positioned and constrained within a locating jig 300 (in the case of a 'U' shaped locating jig, as shown in area A1 of FIG. 19), or constrained between locating jigs 300 (in the case of two locating jigs 300 flanking sides of one or a pair of the intermediate members 200, as shown in FIGS. 16B and 16C), and therefore said intermediate members 200 are not required to be adhesively or mechanically affixed to the substructure or frame 2 themselves. It will be appreciated that in such embodiments, the heights of the side flanges 302 may be equal to or less than a height of the intermediate member 200, as shown in FIG. 16B. It will also be appreciated that in such embodiments, the intermediate member 200 may not be affixed to the frame 2 or other substructure, and thus may not require a fixture perforation 204 extending therethrough, as also shown in FIG. 16B.

The locating jig 300 so configured in any of the above ways may help to align a plurality or all of the intermediate members 200 of a particular assembly, reducing the need to use the before described drilling rig 50 or other means of accurately positioning locating indexing features.

Figure 15A:
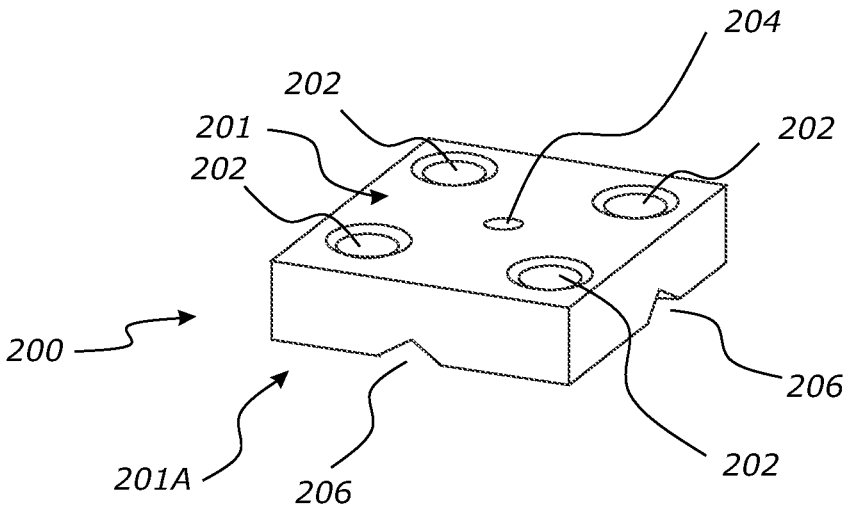
FIG. 15A is a perspective view of an intermediate member.
Figure 15B:
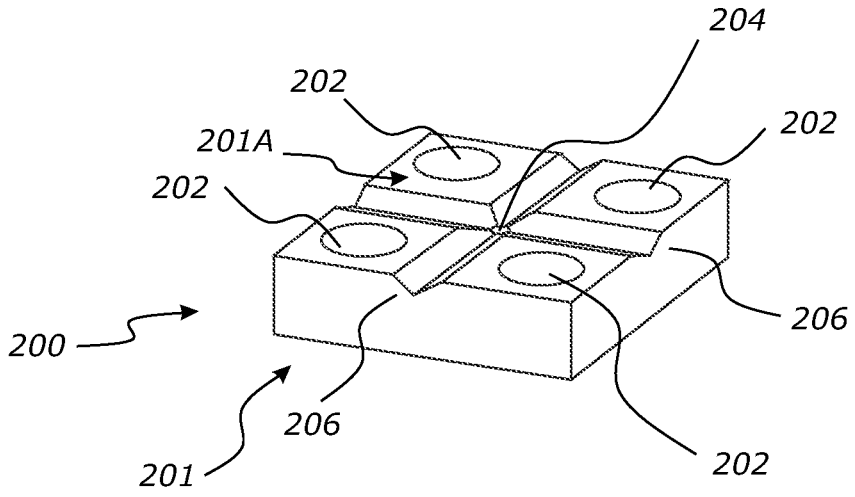
FIG. 15B is a perspective view of the underside of an intermediate member.

The intermediate member 200 is shown taking a substantially square planar form in FIGS. 15A and 15B but may take various other shapes and forms as appreciated by those skilled in the art. The intermediate member 200 may comprise at least one locating indexing feature 202, provided preferably by a hole extending at least partially or fully through the body of the intermediate member 200. In preferred forms, there are two to four, and even more preferably four holes provided to so provide four locating indexing features 202 for cooperation with the projecting pad indexing features, or protrusions 15. In some embodiments, the locating indexing features 202 may be countersunk or comprise chamfers about their holes as shown in FIG. 15A to assist in the interface with the protrusions 15 of the pads.

FIG. 15B shows an underside of an example intermediate member 200 where at least one, preferably two channels 206 are shown extending across the lower surface 201*a* of the intermediate member. The channel or channels 206 may instead be arranged at the upper surface 201 too, in some embodiments. The channel(s) may extend centrally across the intermediate member 200. The intermediate member 200 may be frangible along said channel(s) 206 so as to be breakable into two or more intermediate members.

In this way, the assembler of a tiled floor assembly may customize and configure various intermediate members as suited. For instance, at a notional edge of a floor to be assembled, it may desirable that the square intermediate member 200 having four locating indexing features 202 as shown in FIGS. 15A and 15B by broken along a central channel 206 so as to form two rectangular intermediate members with only two locating indexing features 202 each, thereby providing connection thereto for two pads and thus the edges of tiles affixed thereto being aligned substantially with the notional edge of the floor and of the now broken rectangular intermediate member. The breaking apart along said channel(s) 206 may be performed by hand, or appropriate tools such as pliers or angle grinders and the like, as required.

In some embodiments, the substructure may comprise a plurality of height-adjustable props 100. An example prop 100 is shown in FIGS. 12 and 13. A prop 100 may comprise of a foot 101 and a jacking portion 102 threadingly engaged to the foot. A rotation of the foot relative the jacking portion 102 results in the jacking portion and foot moving apart from each other, thus providing said height adjustability. The jacking portion 102 includes an upper bearing member 105. This may include one or a plurality of locating indexing features 108 with which the pad indexing features or protrusions 15 can register. The bearing member may present itself to support one to four pads and hence one to four corners of tiles.

Figure 17:
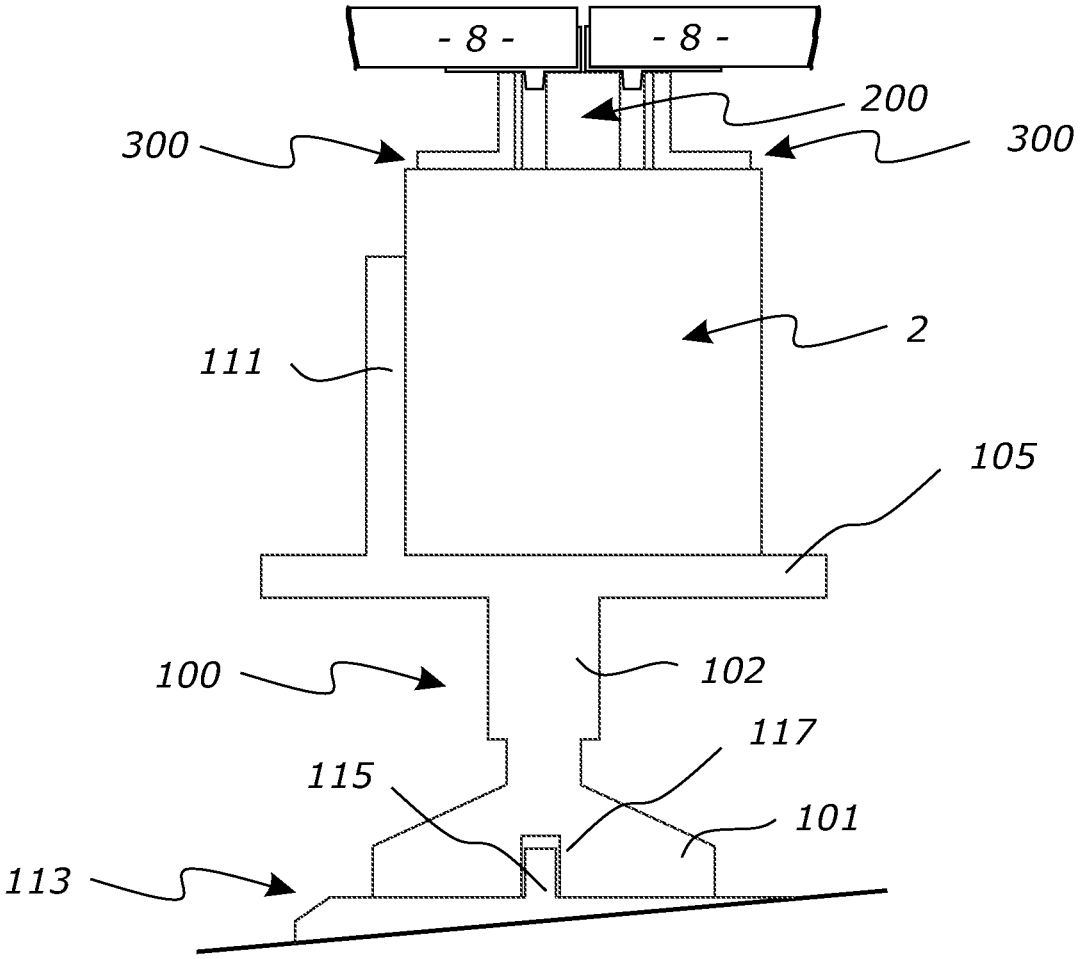
FIG. 17 is a cross sectional view of a wedge and prop.

In some embodiments, the upper bearing member 105 further includes a flange 111 extending upwardly therefrom, as shown in FIG. 17. This flange 111 may be provided for props 100 positioned at edges of a notional floor to be assembled, and can thus be affixed to a lateral part of the substructure, such as a beam, or can otherwise be employed anywhere else under the notional footprint of a floor to be assembled.

The flange 111, in some embodiments, may connect to a substructure portion 2 such as a beam or the like of a frame, with the beam 2 providing a surface with which to affix or mount an intermediate member 200 and/or locating jig 300 as shown in FIG. 17.

Figure 18:
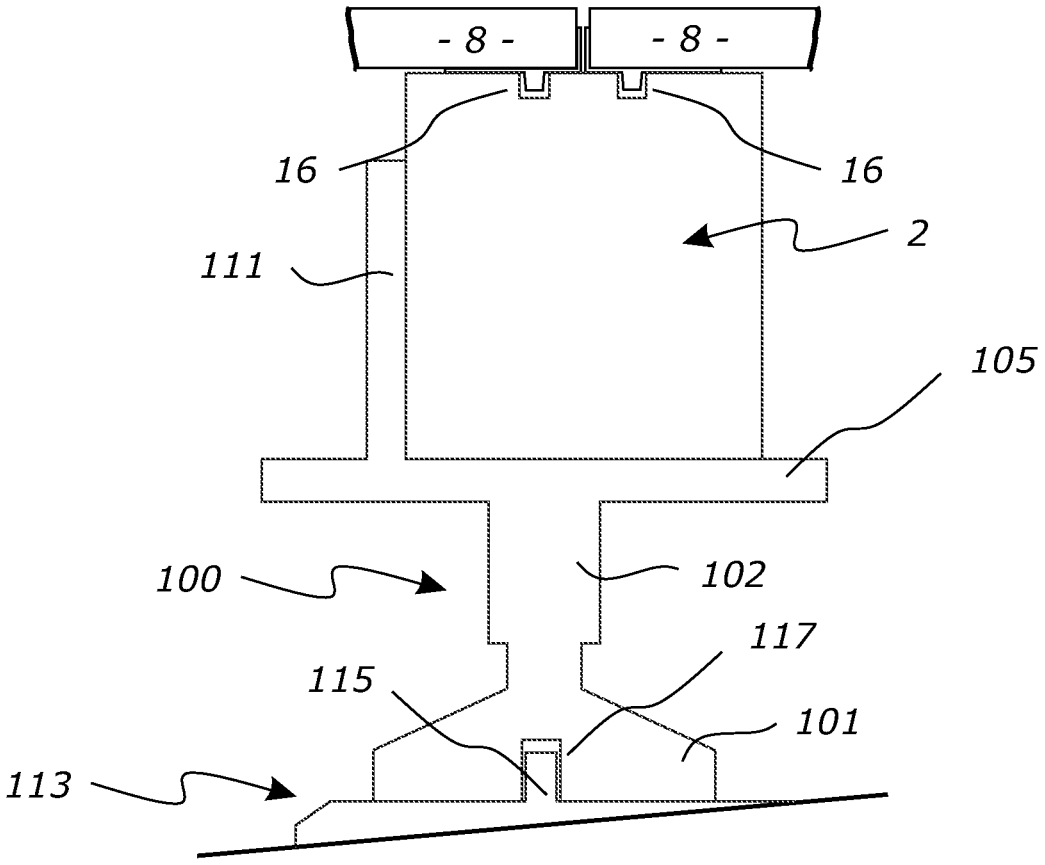
FIG. 18 is a cross sectional view of a wedge and prop.

Alternatively, said substructure portion 2 may merely be used to form holes into a surface thereof and thereby provide locating indexing features 10 for indexing of the tile footing pads as previously described, and as shown in FIG. 18.

In some configurations the flange 111 may be used to connect to a supporting member that does not form part of the substructure, such as a rail or beam, with said rail or beam being usable as described above and shown in FIGS. 17 and 18 to either affix or mount an intermediate member 200 and/or locating jig 300 thereto and/or form locating indexing features 10 into said rail or beam.

In this manner, the flange 111 provides the props with additional functionality in that they may be employed in conjunction with substructure features in some areas, or used in lieu of substructure features in other areas of said substructure of a tiled floor to be assembled. The flange 111 may be frangible so as to be removable from the bearing member 105 of the prop 100 by hands of a user or via tools.

It will thus be appreciated that the props 100 may be employed in lieu of, or together with, other substructures such as timber frame 2 and the like. The height adjustable nature of the props provides additional modularity and configurability to the assembly as a whole. FIG. 17 also shows a levelling wedge 113 comprising a tapered or angled wedge. Said wedge 113 may be provided to level the assembly and its various features when said assembly is supported by props 100 on a non-level substrate. The wedge 113 may therefore comprises various configurations and angles or tapers to suit differently levelled substrates and different increments of level. Finally, the wedge 113 may further comprise a locating pin 115 extending upwardly therefrom and configured to cooperate with a locating orifice 117 located on a bottom surface of the prop 100.

Generally, the various components described herein, such as the props 100, intermediate members 200, wedge 113, locating jig 300, drilling jig 50 and the like, and their associated features and functions provide a modular and customizable tool set for assembly of a tiled floor. The various features can be interchanged and customized to suit different builds and provides on-site flexibility in construction of tiled floors as described herein.

This Is Illustrated in FIG. 19, wherein an example tiled floor assembly is shown schematically extending above a substrate 5, with different aspects of the invention described throughout this specification employed at different areas A1-A4. For instance, a user may employ a locating indexing features 10 drilled or otherwise formed into the substructure 2 for parts of a substructure 2 that is positioned at an appropriate height for a tiled floor assembly, as in area A2, while in other areas also employ intermediate members 200 with locating indexing features 202, as shown in area A1, with a u-shaped locating jig 300 as described above employed for fixture of the intermediate member 200.

In the same build, the user may also employ a prop 100 at portions of the substrate 5 that require height adjustment for correct levelling, with a wedge 113 used to provide angle adjustment of the prop 100, as shown in area A3. The prop in area A3 is also shown supporting a member 2 through its flange 111 as described above, said member 2 providing a locating indexing feature 10 formed into an upper surface thereof. It will be appreciated that said member may instead support a locating jig 300 and/or intermediate member as shown in FIG. 17. Area A4 by contrast shows a prop 100 simply supporting footing pads using its upper bearing member 105, said prop 100 of area A4 being adjusted for height as it is arranged at a portion of the substrate 5 that is lower than another portion, such as that of area A1. Locating jigs 300 and drilling jigs 50 may be used together to appropriately position the corresponding locating indexing features 10, 202. Various other combinations and uses may be envisaged from a combination of the various components described herein and the functions and benefits associated therewith, to assist in modular and on-site configurability of a tiled floor assembly.

It will thus be appreciated that some or all of the components described in this specification may be provided together as a kit of parts for assembling a plurality of tiles to form a tiled floor on or atop a substructure positioned above, and/or or supported by a substrate. This kit of parts may be used by a tradesman or other suitable skilled person for assembly of a tiled floor as required to suit a particular application. Such a kit of parts may include, for example, a plurality of tile footing pads configured to support one or more tile of a plurality of tiles, each pad comprising a pad indexing feature; with the plurality of tile footing pads being arrangeable by a user to locate and connect the plurality of tile footing pads to the substructure through engagement of the pad indexing features of each pad with a locating indexing hole of an array of locating indexing holes provided by or forming part of the substructure, with the plurality of tiles being supported by the plurality of tile footing pads and affixable thereto to form said tiled floor.

The kit of parts may also include a plurality of intermediate members and/or a plurality of height-adjustable props as described hereinbefore, in which case the kit of parts are arrangeable by the user or tradesman to locate and connect the plurality of tile footing pads to the plurality of intermediate members, the plurality of height-adjustable props and/or to the substructure itself through engagement of the pad indexing features of each pad with a locating indexing hole of an array of locating indexing holes provided by or forming part of the intermediate members, the height adjustable props and/or the substructure itself, with the plurality of tiles being supported by the plurality of tile footing pads and affixable thereto to form said tiled floor.

The invention claimed is:

1. A tiled floor assembly for arranging atop a substructure a tiled floor comprising a plurality of tiles, the assembly comprising:

a. a plurality of intermediate members each comprising at least one locating indexing feature, and b. a plurality of tile footing pads, each tile footing pad comprising at least one pad indexing feature and configured to only in part support a tile of the plurality of tiles only at a corner region of said tile, wherein the plurality of intermediate members are configured to be arranged spaced apart atop the substructure so as to form an array of locating indexing features, each tile footing pad of the plurality of tile footing pads being indexed with the array of locating indexing features by said at least one pad indexing feature thereof cooperating with a locating indexing feature of the array of locating indexing features, wherein the at least one pad indexing feature of each tile footing pad of the plurality of tile footing pads comprises a protuberance, and wherein the at least one locating indexing feature of each intermediate member of the plurality of intermediate members comprises a hole extending at least partially through said intermediate member to cooperate with and receive said protuberance, and each tile of the plurality of tiles being, only in part, adhered to and supported only at each of its corner regions by at least one or more of the so-indexed plurality of tile footing pads so as to form said tiled floor.

2. A tiled floor assembly as claimed in claim 1, wherein each tile footing pad of the plurality of tile footing pads has frangible or non-frangible flanges comprising lips against each of which a corner region of a tile of the plurality of tiles can abut.

3. The tiled floor assembly as claimed in claim 1, wherein each intermediate member of the plurality of intermediate members is configured to be affixed to the substructure by way of adhesive and/or by way of at least one fastening member connecting said intermediate member to said substructure.

4. The tiled floor assembly as claimed in claim 3, wherein each intermediate member of the plurality of intermediate members comprises a fixture perforation configured to cooperate with said fastening member to affix the intermediate member to the substructure.

5. The tiled floor assembly as claimed in claim 1, wherein each intermediate member of the plurality of intermediate members is frangible along channels extending across upper or lower surfaces of said intermediate member.

6. The tiled floor assembly as claimed in claim 1, comprising a plurality of spaced apart height adjustable props.

7. The tiled floor assembly as claimed in 6, wherein each spaced apart height adjustable prop of the plurality of spaced apart height adjustable props presents an upper bearing member comprising at least one locating indexing feature such that the plurality of spaced apart height adjustable props form at least part of the array of locating indexing features, at least one tile footing pad of the plurality of tile footing pads thereby being indexed by said at least one pad indexing feature thereof cooperating with a locating indexing feature of the plurality of spaced apart height adjustable props so forming at least part of said array of locating indexing features.

8. The tiled floor assembly as claimed in claim 7, wherein the upper bearing member of each spaced apart height adjustable prop of the plurality of spaced apart height adjustable props comprises a flange extending upwardly therefrom against which a lateral part of the substructure can abut to be affixed thereto.

9. The tiled floor assembly as claimed in claim 8, wherein said flange of the upper bearing member of each spaced apart height adjustable prop of the plurality of spaced apart height adjustable props is frangible so as to be removable from the prop.

10. A method of arranging a tiled floor comprising a plurality of tiles onto or atop a substructure, said method comprising the steps of:

a. arranging a plurality of intermediate members each comprising at least one locating indexing feature spaced apart atop the substructure so as to form an array of locating indexing features, b. providing a plurality of tile footing pads, each tile footing pad comprising at least one pad indexing feature and configured to only in part support a tile of the plurality of tiles only at a corner region of said tile, and c. forming said tiled floor by:

i. placing and indexing at least one tile footing pad of the plurality of tile footing pads within the array of locating indexing features by cooperating the at least one pad indexing feature of the at least one tile footing pad with a locating indexing feature of the array of locating indexing features, wherein the at least one pad indexing feature of each tile footing pad of the plurality of tile footing pads comprises a protuberance, and wherein the at least one locating indexing feature of each intermediate member of the plurality of intermediate members comprises a hole extending at least partially through said intermediate member to cooperate with and receive said protuberance, and only in part adhering at least one tile of the plurality of tiles, only at at least one of its corner regions, to at least one of the so-indexed at least one tile footing pad, and/or ii. adhering only in part at least one tile of the plurality of tiles, only at at least one of its corner regions, to at least one or more of the plurality of tile footing pads, and placing and indexing each tile footing pad of the plurality of tile footing pads so-adhered to said at least one tile with the array of locating indexing features by cooperating the at least one pad indexing feature of each tile footing pad of the plurality of tile footing pads so-adhered to the at least one tile with a locating indexing feature of the array of locating indexing features, wherein the at least one ad indexing feature of each tile footing pad of the plurality of tile footing pads comprises a protuberance, and wherein the at least one locating indexing feature of each intermediate member of the plurality of intermediate members comprises a hole extending at least partially through said intermediate member to cooperate with and receive said protuberance.

11. The method as claimed in claim 10, further comprising the step of providing a plurality of spaced apart height adjustable props and arranging them onto or atop the substructure, each spaced apart height adjustable prop presenting an upper bearing member comprising at least one locating indexing feature such that the plurality of spaced apart height adjustable props form at least part of the array of locating indexing features.

12. The tiled floor assembly as claimed in claim 1, wherein each tile footing pad of the plurality of tile footing pads is supported atop upper surfaces of the plurality of intermediate members.

13. The tiled floor assembly as claimed in claim 1, wherein each tile of the plurality of tiles is quadrilateral shaped with right angle or obtuse angled corner regions.

* * * * *